US006047445A

United States Patent [19]

Mennen

[11] Patent Number: 6,047,445

[45] Date of Patent: Apr. 11, 2000

[54] HINGE DEVICE

[75] Inventor: Martien Mennen, PE Griendtsveen, Netherlands

[73] Assignee: AB Volvo, Sweden

[21] Appl. No.: 09/043,250

[22] PCT Filed: Sep. 11, 1996

[86] PCT No.: PCT/SE96/01132

§ 371 Date: Aug. 4, 1998

§ 102(e) Date: Aug. 4, 1998

[87] PCT Pub. No.: WO97/10404

PCT Pub. Date: Mar. 20, 1997

[30] Foreign Application Priority Data

Sep. 11, 1995 [SE] Sweden ..... 9503136

[51] Int. Cl.[7] ..... E05D 11/06

[52] U.S. Cl. ..... 16/374; 16/375

[58] Field of Search ..... 16/374, 375, 376, 16/377, 334, 289, 292, 348; 296/76; 180/69.2, 69.21

[56] References Cited

U.S. PATENT DOCUMENTS

| | | | |
|---|---|---|---|
| 1,390,579 | 9/1921 | Norquist | 16/374 |
| 1,762,489 | 6/1930 | Stinson et al. | 16/374 |
| 2,067,559 | 1/1937 | Bloom . | |
| 2,201,594 | 5/1940 | Sitts | 16/375 |
| 2,990,572 | 7/1961 | Schwartzberg | 16/375 |
| 4,012,807 | 3/1977 | Kern | 16/375 |
| 4,530,412 | 7/1985 | Sigety, Jr. | 180/69.21 |
| 4,727,621 | 3/1988 | Emery et al. | 180/69.21 |

FOREIGN PATENT DOCUMENTS

| | | |
|---|---|---|
| 2 336 290 A1 | 7/1977 | France . |

*Primary Examiner*—Chuck Y. Mah

*Attorney, Agent, or Firm*—Lerner, David, Littenberg, Krumholz & Mentlik, LLP

[57] ABSTRACT

A hinge for a vehicle hood is disclosed comprising a first hinge for mounting on the vehicle, a second hinge pivotally mounted with respect to the first hinge for mounting on the hood, the second hinge including a projecting portion having an edge defining a predetermined path upon pivoting of the second hinge with respect to the first hinge, a stop associated with the first hinge for cooperating with the projecting portion of the second hinge to define a first end position for the second hinge and a spacer mounted on the first hinge at a position at least partially along the predetermined path of the edge for defining a second end position for the second hinge.

4 Claims, 2 Drawing Sheets

HINGE DEVICE

FIELD OF THE INVENTION

The present invention relates to a hinge device.

BACKGROUND OF THE INVENTION

Motor vehicles are normally fitted with a bonnet or hood which covers a compartment in which the vehicle's engine is arranged. The hood is normally pivotably arranged by means of two hinge devices, one on each side of the hood, for allowing the hood to be raised to a position in which it defines an angle of approximately 60–90° with reference to the longitudinal direction of the vehicle.

A hinge device which allows the hood to be opened and raised to an "inspection position," corresponding to an angle of approximately 60°, or a "service position," corresponding to an angle of approximately 90°, is previously known. For this purpose, the known hinge device comprises a release mechanism which can be manually operated so as to select the 60° position or the 90° position.

A problem which occurs with such a previously known device is that the hood cannot be locked in the 90° position, which of course may inflict injuries if the hood were to fall down. Another problem is that the release mechanism might be "too easily" activated by the user; i.e. the hood may unintentionally be raised to the 90° position if for example the owner of the car, who normally should not need to open the hood to the 90° position, activates the release mechanism. If for example the windscreen wipers are in their folded out position, this may result in the hood being damaged.

SUMMARY OF THE INVENTION

A main object of the present invention is therefore to provide a hinge device for a vehicle which solves the above-mentioned problems and which provides a simple, cheap and functionally secure hinge device.

In accordance with the present invention, this and other objects have now been accomplished by the invention of a hinge for a vehicle hood comprising a first hinge member for mounting on the vehicle, a second hinge member pivotably mounted with respect to the first hinge member, the second hinge member including a projecting portion including an edge defining a predetermined path upon pivoting of the second hinge member with respect to the first hinge member, a stop associated with the first hinge member for cooperating with the projecting portion of the second hinge member to define a first end position for the second hinge member, and a spacer mounted on the first hinge member at a position at least partially along the predetermined path of the edge for defining a second end position for the second hinge member. In accordance with a preferred embodiment, the spacer is movably mounted on the first hinge member.

In accordance with one embodiment of the hinge of the present invention, the first hinge member includes an aperture, and the spacer comprises a bolt projecting through the aperture and a cooperating nut for the bolt.

In accordance with another embodiment of the hinge of the present invention, the spacer is removably mounted on the first hinge member, whereby upon removal of the spacer the second hinge member may be pivoted into the first end position, and upon remounting of the spacer the second hinge member is prevented from being pivoted towards the second end position.

The present invention thus comprises a first hinge element and a second hinge element which are pivotably arranged in relation to each other. The second hinge element is preferably fastened to the hood of a vehicle. The first hinge element comprises a stop element which cooperates with a projecting element on the second hinge element, thus defining the "inspection position." Furthermore, the first hinge element comprises an arrangement with a bolt and a nut which defines the "service position." This gives a simple and effective hinge device, which also allows the hood to be locked in the "service position."

Consequently, the hinge device according to the present invention has both a stop function, for allowing the hood to be raised to the 60° position or the 90° position, and locking function in which the hood can be locked in the 90° position.

Furthermore, the hinge device according to the present invention effectively prevents the user from unintentionally raising the hood to the 90° position. This is due to the fact that a bolt and nut is used, which cannot be unscrewed by chance.

BRIEF DESCRIPTION OF THE DRAWINGS

The invention will now be described with reference to he following detailed description, which refers to the annexed drawings, in which.

DETAILED DESCRIPTION

Figure 1:
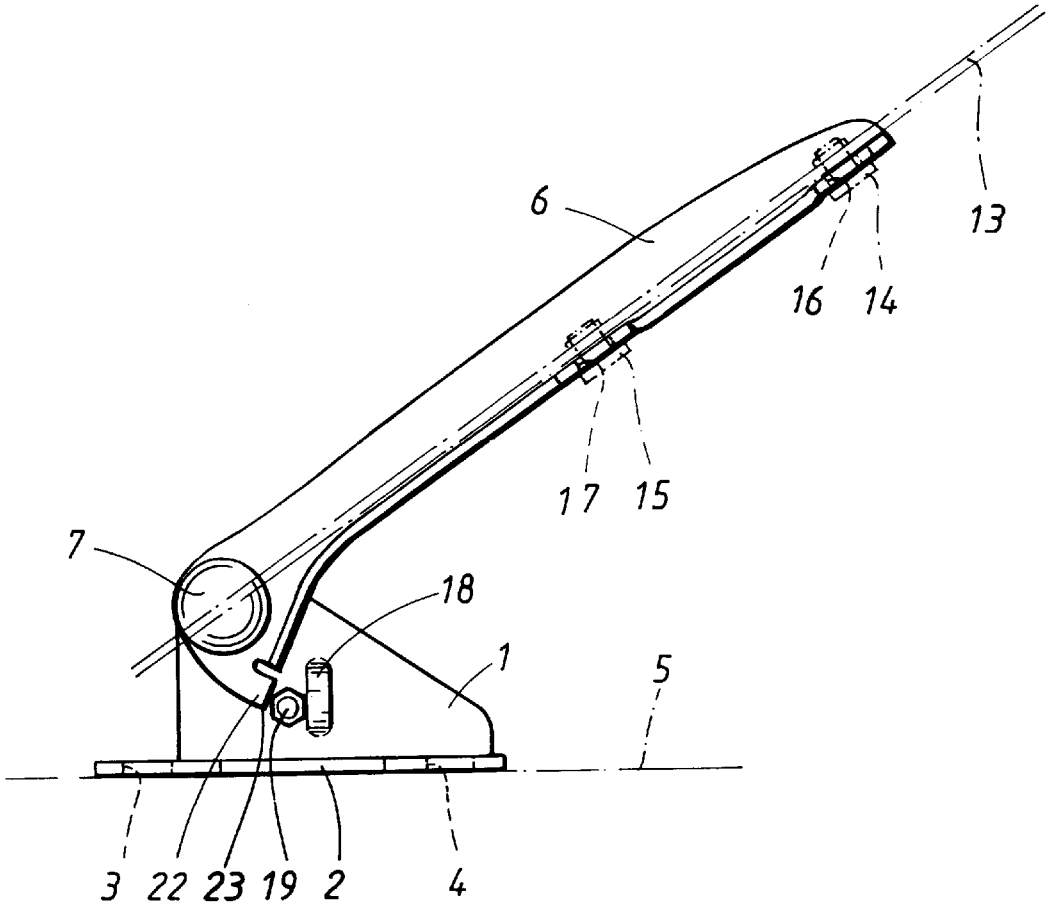
FIG. 1 is a side, elevational view showing the hinge device,according to the present invention in its "inspection" position.
Figure 2:
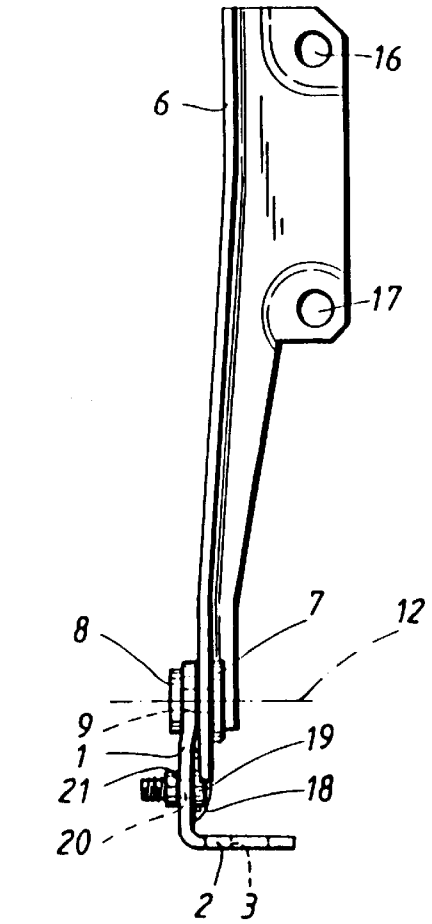
FIG. 2 is a front, elevational view of the hinge device shown FIG. 1.

FIGS. 1 and 2 show a hinge device according to the present invention in a first position. The hinge device is particularly suitable for pivotably arranged vehicle hoods or bonnets. According to a preferred embodiment, the hinge device comprises a first hinge element in the form of a mounting 1. As is apparent from FIG. 2, the mounting 1 has a generally L-shaped cross section and comprises a bottom section 2 provided with through holes 3 and 4. The hinge device is fastened to the body of a vehicle by means of screws or bolts (not shown) which are inserted through the holes, 3 and 4, and are fastened to the vehicle. The surface of the vehicle body is schematically shown by means of line 5.

The hinge device also comprises a second hinge element in the form of an essentially elongated arm 6 which is pivotally arranged on the mounting 1. To this end, a rivet joint (or alternatively a screw joint) is formed by a first rivet head 7 and a second rivet head 8 (see FIG. 2) which are connected by means of a shank 9 which is arranged in holes through the arm 6 and the mounting 1. Consequently, an axis of rotation 12 is defined by the shank 9.

The arm 6 is adapted to be fixed to the vehicle's hood 13 by means of screw or bolt joints, 14 and 15, or the like, which are arranged in two holes, 16 and 17, respectively, in the arm 5 and corresponding holes in the hood 13.

As is apparent from FIG. 1, mounting 1 comprises a stop element 18, which preferably is formed by a protruding section which forms a shoulder in the mounting 1. Moreover, a spacer element in the form of a bolt 19 is arranged in a further hole 20 (see FIG. 2) in the mounting 1, and cooperates with a nut 21 on the reverse side of the mounting 1. The stop element 18 protrudes from the surface of the mounting 1 at a distance which is approximately equivalent to the height of the bolt's 19 head.

The hole 20 is arranged so that the head of the bolt 19 becomes situated adjacent to the stop element 18. Alternatively, bolt 19 and nut 21 can be arranged the other way around, i.e. so that the nut 21 becomes situated adjacent to the stop element 18.

Furthermore, the arm 6 is formed with a projecting section in the form of a tab 22. During operation, i.e. when the hood 13 is opened, the arm 6 pivots about the axis 12 from a position in which the arm 6 is essentially parallel to the surface 5 (i.e. the hood 13 is closed) until it reaches a position in which the tab 22 contacts the bolt 19. The bolt 19, in turn, may be in contact with the stop element 18. This prevents the hood 9 from being raised further. This end position of the hood 13 corresponds to an "inspection position" in which the hood 13 forms an angle with reference to the surface 5 which is approximately 40–70°, preferably about 60°. As is apparent from FIG. 1, the tab 22 has an outer edge 23 which during the pivoting movement of the arm 6 defines an outer limit, or boundary line, of an area around the axis 12. The bolt's 19 head is arranged at least partly inside this line of movement which is defined by the tab 22.

Figure 3:
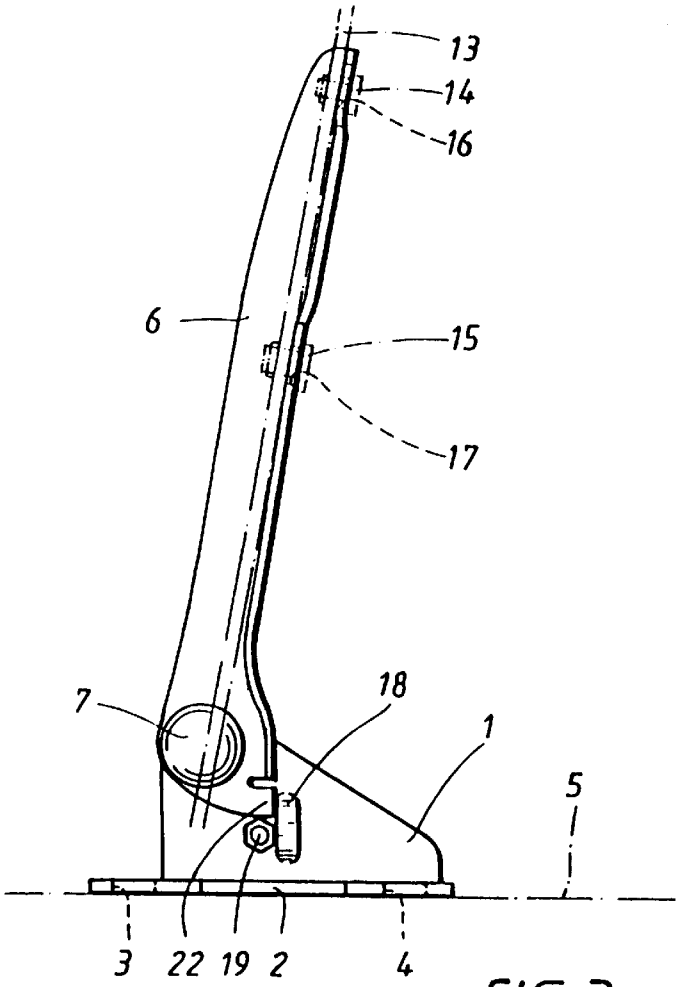
FIG. 3 is a side, elevational view showing the hinge device according to the present invention in its "service" position.

If the user wishes to raise the hood 13 to its "service position," in which it forms an angle of approximately 90° to the surface 5, the user must unscrew and remove the bolt 19 from the mounting 1. This makes it possible to raise the hood 13 further, until the tab 22 contacts the stop element 18. FIG. 3 shows the hinge device according to the present invention in this "service position."

The arm 6, and consequently also the hood 13, can be locked in the "service position" by once again fastening the bolt 19 and nut 21. As is apparent from FIG. 3, the tab 22 has a slightly curved outer surface which is in contact with the bolt's 19 head when the latter is positioned in the hole 20. This makes it impossible to swing back the arm 6, i.e. to lower the hood 13. Thus, the hood 13 cannot be lowered until the bolt 19 once again has been removed.

The locking of the arm 6 in the "service position" is facilitated through the fact that the bolt's 19 head has six sides, so that one of its sides is situated parallel to the stop element 18 and one of its edges acts as a stop for the lower, outer surface of the tab 22.

The present invention is not limited to the above-mentioned embodiment, but may be varied within the scope of the appended claims. For example, the values of the angles corresponding to the "inspection position" and "service position," respectively, may vary. In addition, a plurality of holes can be provided, with each hole defining a certain end position of the arm 6, i.e. a certain angle of the arm 6 in relation to the mounting 1.

The bolt 19 and nut 21 arrangeent can be removed and then fastened again. According to an alternative embodiment, the invention can comprise a spacer element in the form of a movable element, for example a pin or the like which may be forced by a spring to a position in which it acts as a spacer element. When the hood 13 should be completely raised, the pin can be manually moved by pushing or pulling it away against the force of the spring, thereby allowing the tab 22 to pass and the arm 6 to be pivoted further.

Furthermore, a vehicle can be provided with one or two hinge devices according to the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A hinge for a vehicle hood comprising a first hinge member for mounting on said vehicle, a second hinge member pivotally mounted with respect to said first hinge member, said second hinge member including a projecting portion including an edge defining a predetermined path upon pivoting of said second hinge member with respect to said first hinge member, a stop associated with said first hinge member for cooperating with said projecting portion of said second hinge member to define a first end position for said second hinge member, and a spacer removably mounted on said first hinge member at a position at least partially inside said predetermined path of said edge for defining a second end position for said second hinge member.

2. The hinge of claim 1 wherein said spacer is movably mounted on said first hinge member.

3. The hinge of claim 1 wherein said first hinge member includes an aperture, and wherein said spacer comprises a bolt projecting through said aperture and a cooperating nut for said bolt.

4. The hinge of claim 1 wherein said spacer is removably mounted on said first hinge member, whereby upon removal of said spacer said second hinge member may be pivoted into said first end position, and upon remounting of said spacer said second hinge member is prevented from being pivoted towards said second end position.

* * * * *